US009091513B2

(12) United States Patent
Shand

(10) Patent No.: US 9,091,513 B2
(45) Date of Patent: Jul. 28, 2015

(54) METHOD AND APPARATUS FOR GUIDED MISSILE AND/OR NET SHIELD

(76) Inventor: Jason J. Shand, Wallington, NJ (US)

( * ) Notice: Subject to any disclaimer, the term of this patent is extended or adjusted under 35 U.S.C. 154(b) by 189 days.

(21) Appl. No.: 13/605,097

(22) Filed: Sep. 6, 2012

(65) Prior Publication Data

US 2014/0231575 A1 Aug. 21, 2014

(51) Int. Cl.

| | |
|---|---|
| ***F41H 13/00*** | (2006.01) |
| ***F42B 10/60*** | (2006.01) |
| ***F42B 12/20*** | (2006.01) |
| ***F42B 12/56*** | (2006.01) |
| *F42B 10/00* | (2006.01) |
| *F42B 12/00* | (2006.01) |

(52) U.S. Cl.
CPC ..... *F41H 13/0006* (2013.01)

(58) Field of Classification Search
CPC ..... F41H 11/00; F41H 11/02; F41H 11/04; F41H 13/00; F41H 13/0006; F42B 12/02; F42B 12/36; F42B 12/56; F42B 12/58; F42B 12/66
USPC ..... 244/3.1–3.3; 89/1.1, 1.11; 43/58; 114/382; 169/43, 46, 47
See application file for complete search history.

(56) References Cited

U.S. PATENT DOCUMENTS

| | | | | |
|---|---|---|---|---|
| 4,912,869 | A * | 4/1990 | Govett | 89/1.11 |
| 4,958,571 | A | 9/1990 | Puckett | 102/522 |
| 5,417,139 | A * | 5/1995 | Boggs et al. | 89/1.11 |
| 5,583,311 | A * | 12/1996 | Rieger | 89/1.11 |
| 5,750,918 | A * | 5/1998 | Mangolds et al. | 89/1.11 |
| 5,898,125 | A * | 4/1999 | Mangolds et al. | 89/1.11 |
| 5,988,036 | A | 11/1999 | Mangolds | 86/1.1 |
| 6,325,015 | B1 * | 12/2001 | Garcia et al. | 114/382 |
| 6,394,016 | B2 * | 5/2002 | Swartout et al. | 114/382 |
| 6,626,077 | B1 * | 9/2003 | Gilbert | 89/1.11 |
| 6,695,068 | B2 * | 2/2004 | Woodall et al. | 169/47 |
| 6,904,838 | B1 * | 6/2005 | Dindl | 89/1.1 |
| 7,398,617 | B2 * | 7/2008 | Mattox | 43/58 |
| 7,786,417 | B2 * | 8/2010 | Sells, II | 244/3.1 |
| 7,977,614 | B2 * | 7/2011 | Raviv | 244/3.11 |
| 8,122,810 | B2 * | 2/2012 | Glasson | 89/1.11 |
| 8,399,816 | B2 * | 3/2013 | Glasson | 244/3.1 |
| 2006/0169832 | A1 * | 8/2006 | Glasson | 244/3.1 |
| 2007/0261542 | A1 * | 11/2007 | Chang et al. | 89/1.11 |

FOREIGN PATENT DOCUMENTS

| | | | | |
|---|---|---|---|---|
| GB | 2166225 | A * | 4/1986 | F41H 13/00 |

* cited by examiner

*Primary Examiner* — Bernarr Gregory
(74) *Attorney, Agent, or Firm* — Walter J. Tencza, Jr.

(57) ABSTRACT

An apparatus including a body portion, a plurality of missiles attached to the body portion in a manner which allows the plurality of missiles to detach from the body portion, a net having a plurality of locations, wherein each missile is attached to the net at a different location of the plurality of locations, and means for controlling a flight direction and a flight speed of each of the plurality of missiles. The means for controlling the flight direction and the flight speed of each of the plurality of missiles may include a computer processor attached to each of the plurality of missiles. A majority of the net may lie inside of an inner chamber inside of the body portion, and the at least a majority of the net may be configured to come out of the inner chamber in response to a command from a control device.

20 Claims, 23 Drawing Sheets

METHOD AND APPARATUS FOR GUIDED MISSILE AND/OR NET SHIELD

FIELD OF THE INVENTION

This invention relates to improved methods and apparatus concerning deployed nets in military applications.

BACKGROUND OF THE INVENTION

Military personnel have applications requiring a defensive wall for the blockage/stoppage of on-coming objects such as torpedoes, missiles/rockets, or air vehicles. A variety of devices have been developed over the years to ballistically deliver restraining nets. These known devices may differ in the method used for deploying, unfurling, and controlling the net in fight. For example, a net gun disclosed in U.S. Pat. No. 4,912,869, to Govett, uses a plurality of barrels to launch projectiles with diverging flight paths to drag a net package to a target and deploy the net in flight. In the ballistically deployed restraining system disclosed in U.S. Pat. No. 5,988,036, Mangolds, et al., a spreader charge and weights are used to spread a net in flight. Other prior art systems utilize a system that deploys a net towards one general direction or area. All of these systems suffer from the same disadvantage that once the net is deployed or unfurled, the operator no longer has control of the net.

SUMMARY OF THE INVENTION

It is an object of the present invention to provide apparatus for effective control and maneuverability of a net post deployment and unfurling so that on-coming projectiles can be stopped, block, or destroyed subsurface, surface, anti-air warfare or air-to-air.

In at least one embodiment, a guided missile net/shield device is provided, which utilizes an outer casing, a primary ring, a means of propulsion, a transmitter, a receiver, a plurality of explosive ordinances, and a net. In at least one embodiment the guided missile net, when unfurled, has cusps serving as a perimeter. A series of launchers are provided in which the packed net and ordnances are loaded and which the packed guided net is launched towards a target when desired. The plurality of launchers, although independent, act in unison. Within the launcher, there exists a data transmitter and a data receiver. A controller sends data to the launchers. The launchers receive the data and deploy towards a target. Once the target is in range, the launchers detach from the outer casing. The detached launchers then unfurl the net by traversing simultaneously outward and forward away from the outer casing. The fully unfurled net is guided to the target by the launchers. The guided net forms an entirely impenetrable wall or a substantially impenetrable wall. Once launched or once unfurled, the net can be controlled and guided either manually or autonomously to acquire a target. Once a target has been acquired or is close to the net, the option to detonate the ordnances and destroy the target can be exercised. The guided net can also be utilized as a shield by positioning itself between on-coming objects in the foreground and objects (submarines/ships, etc.) in the background.

In at least one embodiment of the present invention a guided net is provided comprising an outer casing, a primary ring, a plurality of firing launchers connected to the outer casing, and ordnances. Multiple quarter segments are split longitudinally and come together to form the outer casing. The outer casing is segmented and forms a cylinder. In at least one embodiment, the outer casing opens up perpendicular to a central axis of the primary ring and is interlocked with a primary ring located at the base. The base of one launcher is interlocked at the side edges of two outer casings and is slideable length wise.

In at least one embodiment, guided net is launched into water or air by main thrusters. The thrusters guide the net closer to a target or destination. The thrusters have the capability to change direction or speed as deemed necessary to ascertain its target. Once the net is in the vicinity of the target/destination, a signal is given for the thrusters to unlock from the outer casing. Simultaneously the thrusters traverse the length of the outer casing. Once the thrusters have passed an end tip of the outer casing, each segment of the outer casing is free to open perpendicularly to the central axis of the primary ring. Once free from the outer casing, the thrusters are set to expand both latitudinally and longitudinally as to unfurl the packed net. The unfurled net is now ready to either form a stationary or transitory blockade based on the movement of the target or input from the controller. Preferably, in at least one embodiment, the launcher also include gas sealed members in the outer casing between the seams of each segment and the base of each launcher. Detonation of ordnances may be triggered by a proximity fuse.

In at least one embodiment, an apparatus is provided which includes a body portion, a plurality of missiles attached to the body portion in a manner which allows the plurality of missiles to detach from the body portion, a net having a plurality of locations, wherein each missile is attached to the net at a different location of the plurality of locations, and means for controlling a flight direction and a flight speed of each of the plurality of missiles. The means for controlling the flight direction and the flight speed of each of the plurality of missiles may include a computer processor attached to each of the plurality of missiles.

In at least one embodiment, at least a majority of the net lies inside of an inner chamber inside of the body portion, and the at least a majority of the net is configured to come out of the inner chamber in response to a command from a control device. The body portion may be configured to go from a closed state to an open state in response to the command from the control device, wherein in the closed state the majority of the net can not come out of the inner chamber of the body portion, and wherein in the open state the majority of the net comes out of the inner chamber of the body portion.

In at least one embodiment, the net is substantially circular; and the plurality of missiles includes a first missile attached to a northern location of the net, a second missile attached to a southern location of the net, a third missile attached to a western location of the net, and a fourth missile attached to an eastern location of the net. In at least one embodiment, the northern location on the net is at the periphery of the net; the southern location on the net is at the periphery of the net; the eastern location on the net is at the periphery of the net; and the western location on the net is at the periphery of the net.

The apparatus may further include a first ordnance attached to the net. The first ordnance may be an explosive device which explodes when triggered by a remote control signal. The net may have a periphery; and the plurality of missiles may be attached to the net and the first ordnance may be attached to the net so that the plurality of missiles are closer to the periphery than the first ordnance.

In at least one embodiment of the present invention a method is provided which includes packing a majority of a net into an inner chamber of a body portion; attaching the net to a plurality of missiles; attaching the plurality of missiles to the body portion; launching and detaching the plurality of missiles from the body portion; and controlling a flight direction and a flight speed of each of the plurality of missiles to cause the majority of the net to come out of the inner chamber of the body portion and to cause the majority of the net to expand.

DETAILED DESCRIPTION OF THE DRAWINGS

Figure 1A:
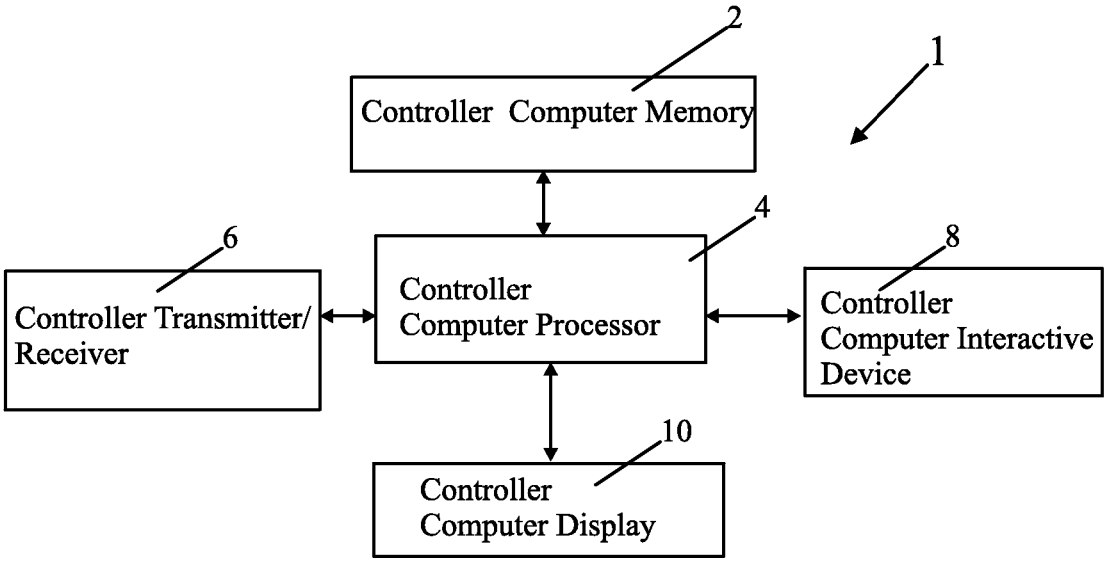
FIG. 1A shows a block diagram of a controller for controlling a net device in accordance with one or more embodiments of the present invention.

FIG. 1A shows a block diagram of a controller 1 for controlling a net device, such as net device 200 shown in FIGS. 2A-9F, in accordance with one or more embodiments of the present invention. The controller 1 includes a controller computer memory 2, a controller computer processor 4, a controller transmitter/receiver 6, and a controller computer interactive device 8. The controller computer memory 2, the controller transmitter/receiver 6, the controller computer interactive device 8, and the controller computer display 10 may be connected to and/or may communicate with the controller computer processor by communications links such as any known hardwired, wireless, optical, or any other communications links.

Figure 1B:
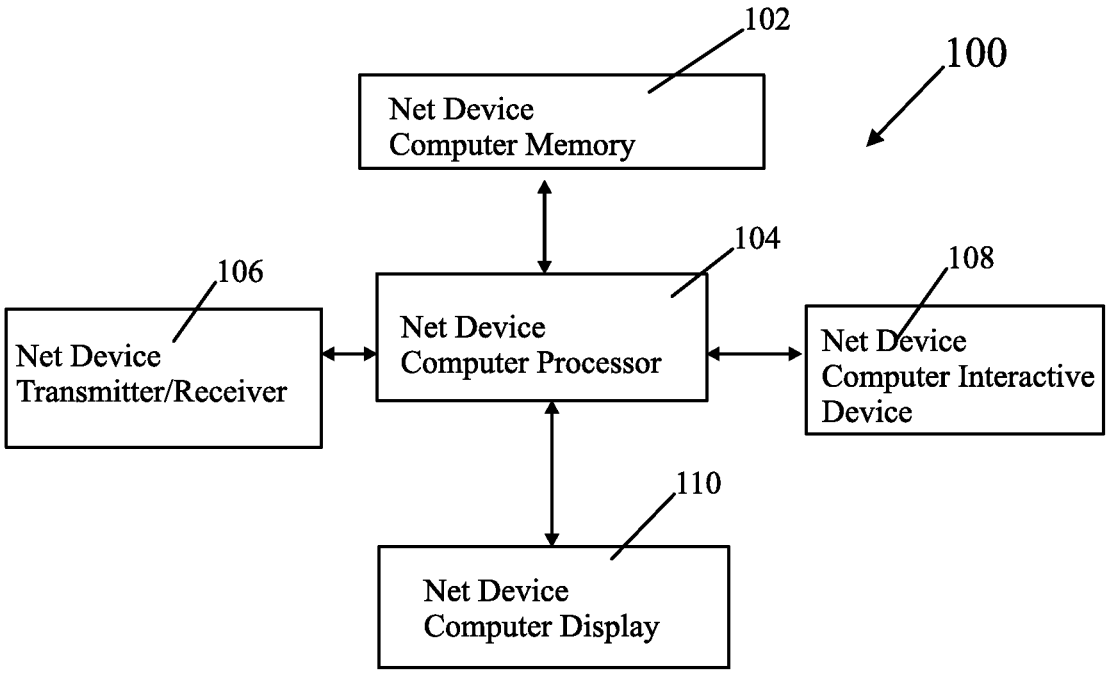
FIG. 1B shows a block diagram of components of a net device.

FIG. 1B shows a block diagram 100 of some components which may be incorporated in or on the net device 200. The components shown in the block diagram 100 may include a net device computer memory 102, a net device computer processor 104, a net device transmitter/receiver 106, a net device computer interactive device 108, and a net device computer display 110.

In operation the controller 1 may transmit signals via the controller transmitter/receiver 6 to the net device transmitter/receiver 106, which may cause the net device computer processor to control various parts of the net device 200 shown in FIGS. 2A-9F, as will be explained.

Figure 2A:
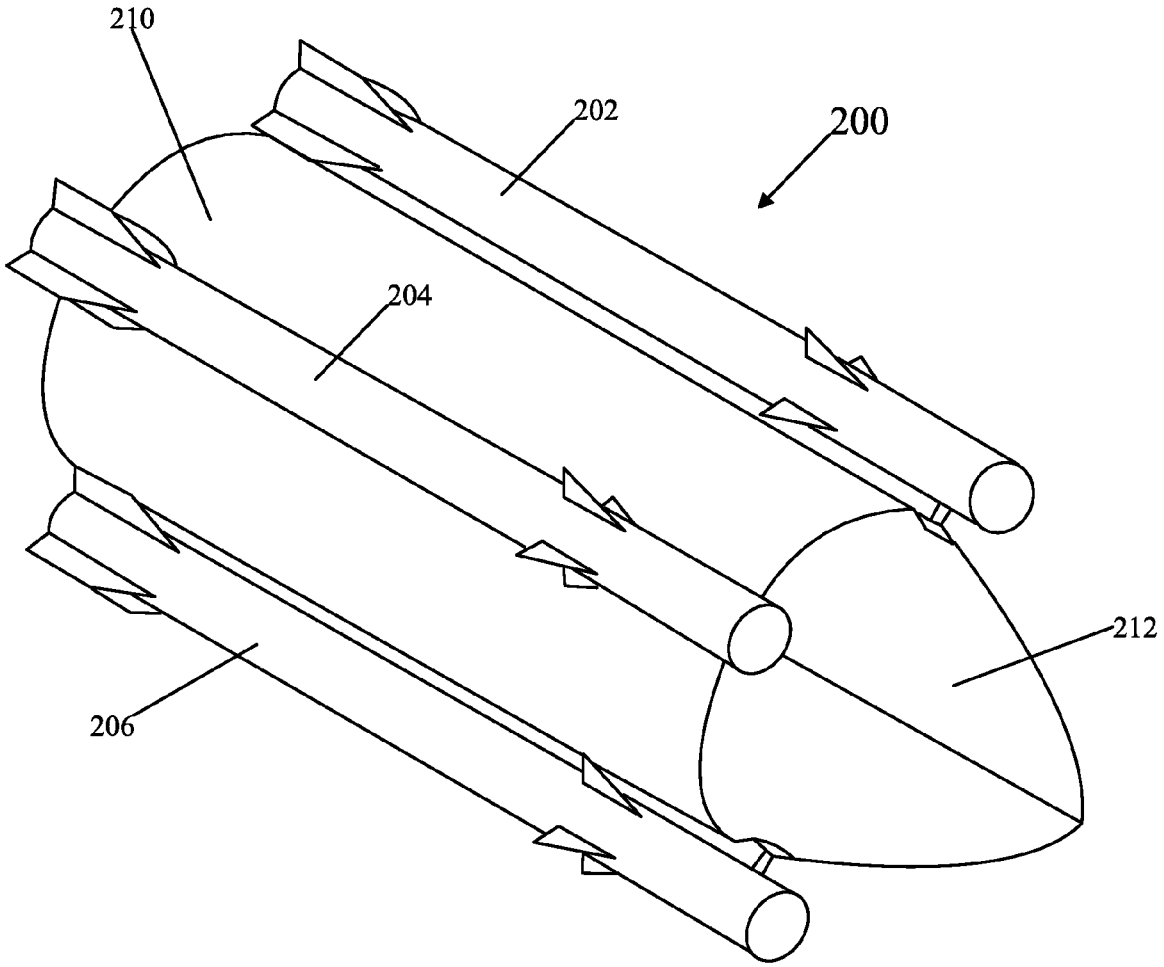
FIG. 2A shows a front, top, left perspective view of a net device in accordance with an embodiment of the present invention, with the net device of FIG. 2A in a first state.
Figure 2B:
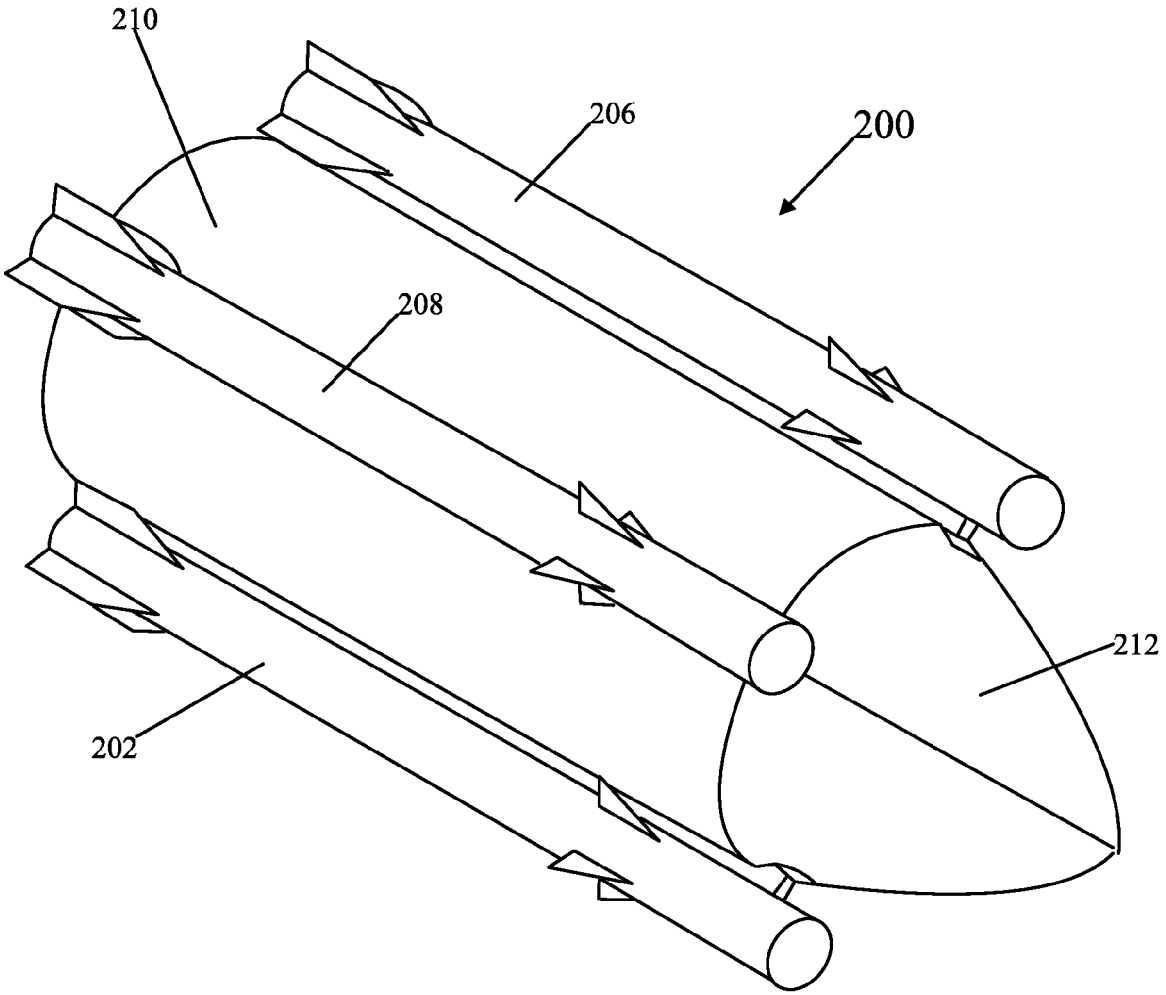
FIG. 2B shows a rear, top, right perspective view of the net device of FIG. 2A, with the net device of FIG. 2A in a first state.

FIG. 2A shows a front, top, left perspective view of the net device 200 in accordance with an embodiment of the present invention, with the net device 200 in a first state. FIG. 2B shows a rear, top, right perspective view of the net device 200, with the net device of FIG. 2A in the first state. As shown by FIGS. 2A-2B, the net device 200 includes missiles or rockets 202, 204, 206, and 208. The net device also includes section 210 and section 212. The missies or rockets 202, 204, 206, and 208 are attached to the section 210 in FIGS. 2A-2B.

Figure 3:
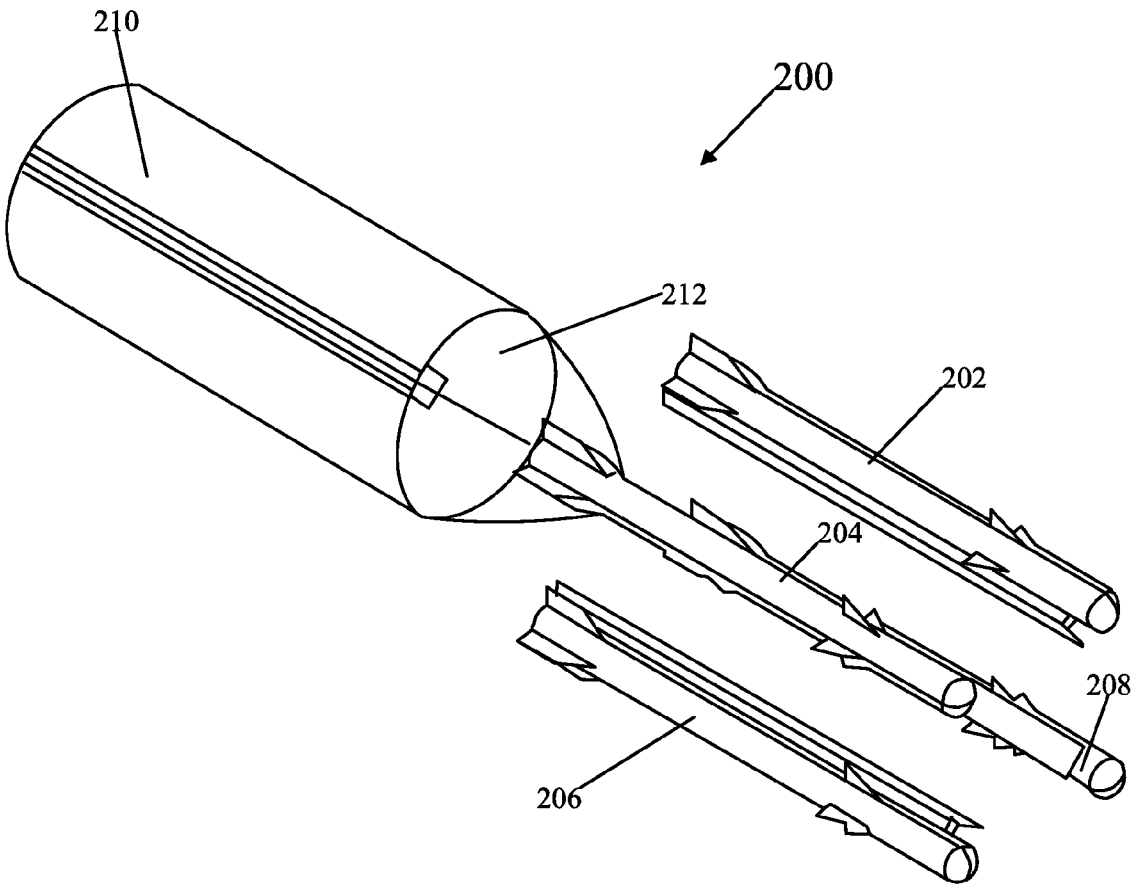
FIG. 3 shows a front, top, left perspective view of the net device of FIG. 2A, with the net device of FIG. 2A in a second state.

FIG. 3 shows a front, top, left perspective view of the net device 200, with the net device 200 in a second state, in which the missiles 202, 204, 206, and 208 have been launched or otherwise moved and disconnected from the section 210.

Figure 4:
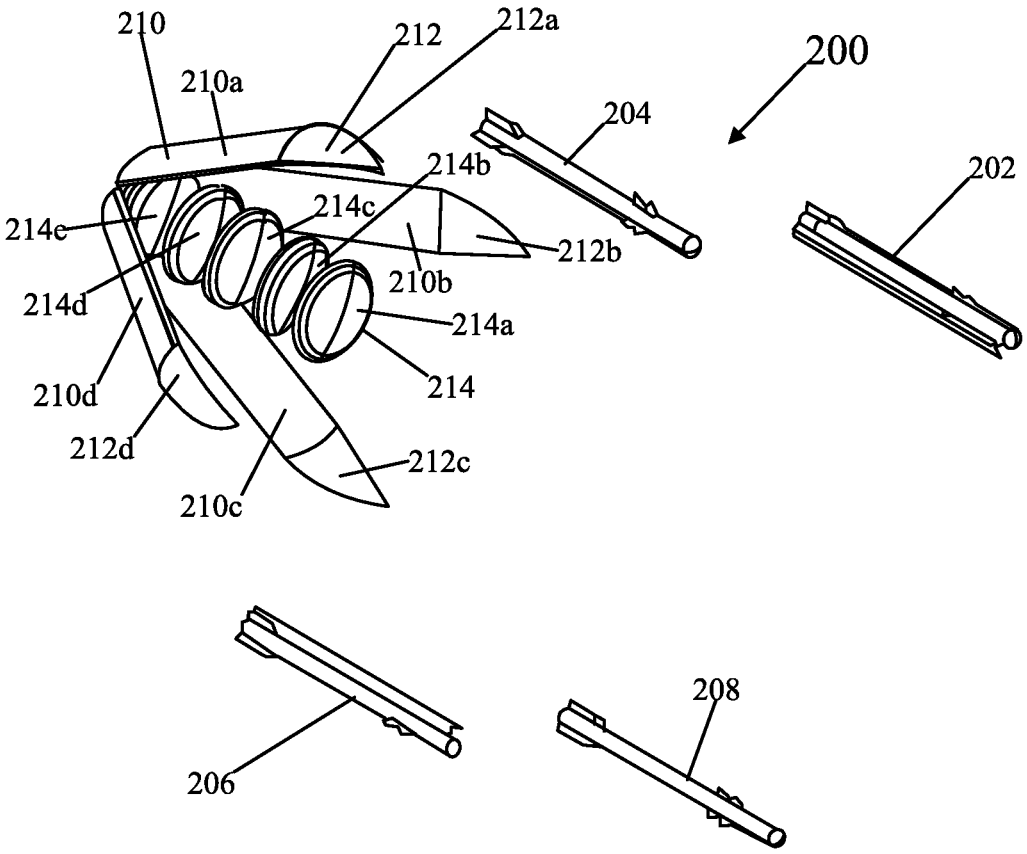
FIG. 4 shows a front, top, left perspective view of the net device of FIG. 2A, with the net device of FIG. 2A in a third state.

FIG. 4 shows a front, top, left perspective view of the net device 200 of FIG. 2A, with the net device 200 in a third state, in which the missiles 202, 204, 206, and 208 have been moved further, and the sections 210 and 212 have opened up. The section 210 includes subsections 210*a*, 210*b*, 210*c*, and 210*d*; and the section 212 includes subsections 212*a*, 212*b*, 212*c*, and 212*d*. In FIG. 4, the sections 210, and 212 have opened up and/or split apart into subsections 210*a-d* and subsections 212*a-d*. This exposes a plurality 214 of circular or substantially circular disks including disks 214*a*-214*e*, which were previously (in the first and second states) located within a cavity with a combination of sections 210 and 212. Each of the disks 214 may be an ordnance, such as a military weapon or gun. Each of the disks 214 may be or may be replaced by any shape or size ordnance that may be stored in an inner chamber enclosed by the sections 210*a-d* and 212*a-d* when the net device 200 is in the closed state of FIG. 2A. However cylindrical ordnances may fit better within the inner chamber enclosed with the net device 200.

Figure 5:
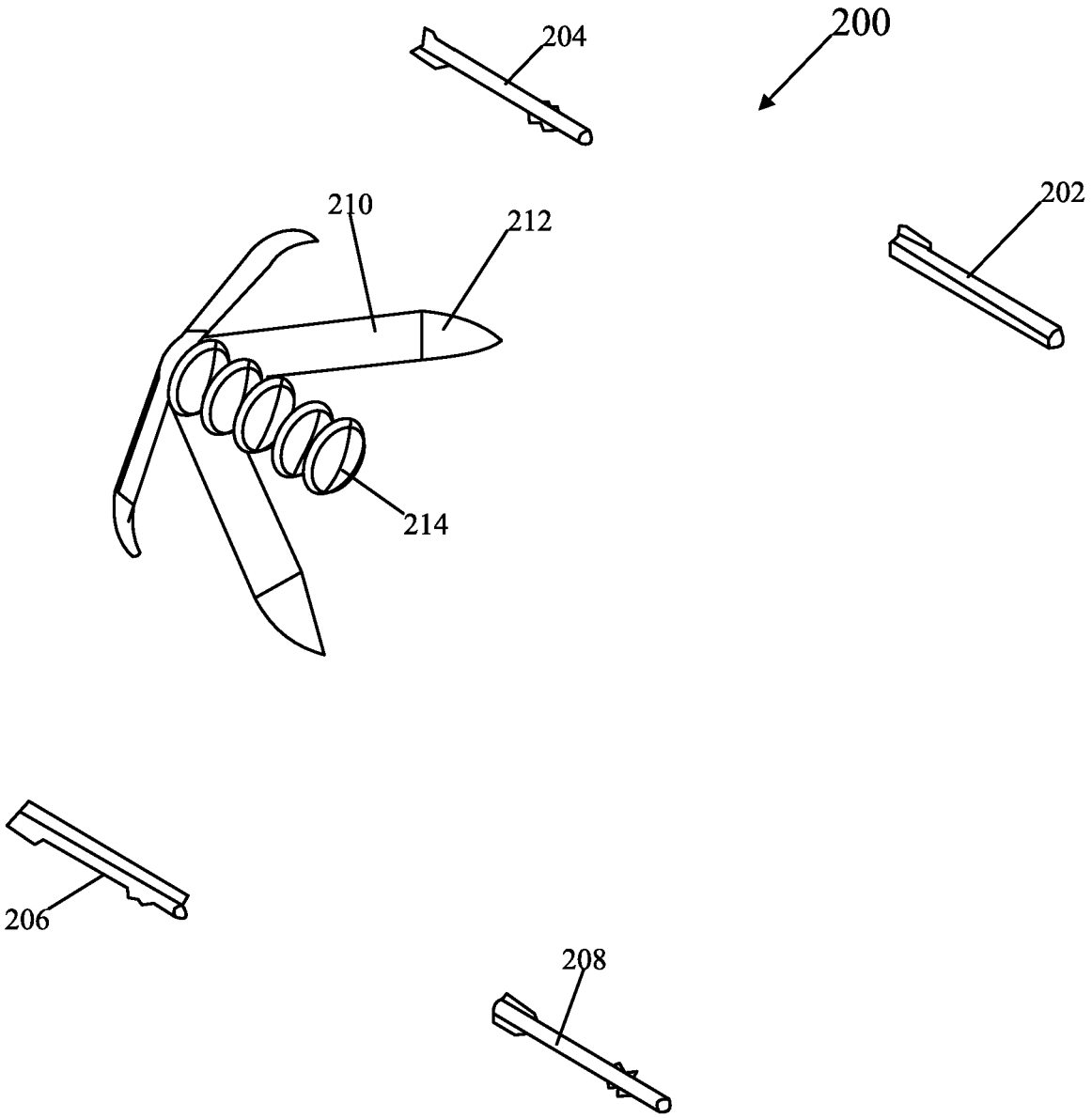
FIG. 5 shows a front, top, left perspective view of the net device of FIG. 2A, with the net device of FIG. 2A in a fourth state.

FIG. 5 shows a front, top, left perspective view of the net device 200, with the net device 200 in a fourth state in which the missiles 202, 204, 206, and 208 have spread out further. The missiles 202, 204, 206, and 208 may be controlled by computer processor 4 and/or computer processor 104 of FIGS. 1A and 1B, respectively. The opening of the sections 210*a-d* and 212*a-d*, such as from FIG. 3 to FIG. 4, from FIG. 4 to FIG. 5, from FIG. 5 to FIG. 6 may be controlled by the computer processor 4 and/or the computer processor 104. The movement of the ordnances or disks 214*a-e*, such as from FIG. 5 to FIG. 6, from FIG. 6 to FIG. 7, and from FIG. 7 to FIG. 8 may be controlled by computer processor 4 and/or the computer processor 104. Each of the ordnances or disks 214*a-e* may have its own flight control and/or propulsion device which can be controlled by computer processor 4 and/or computer processor 104.

Figure 6:
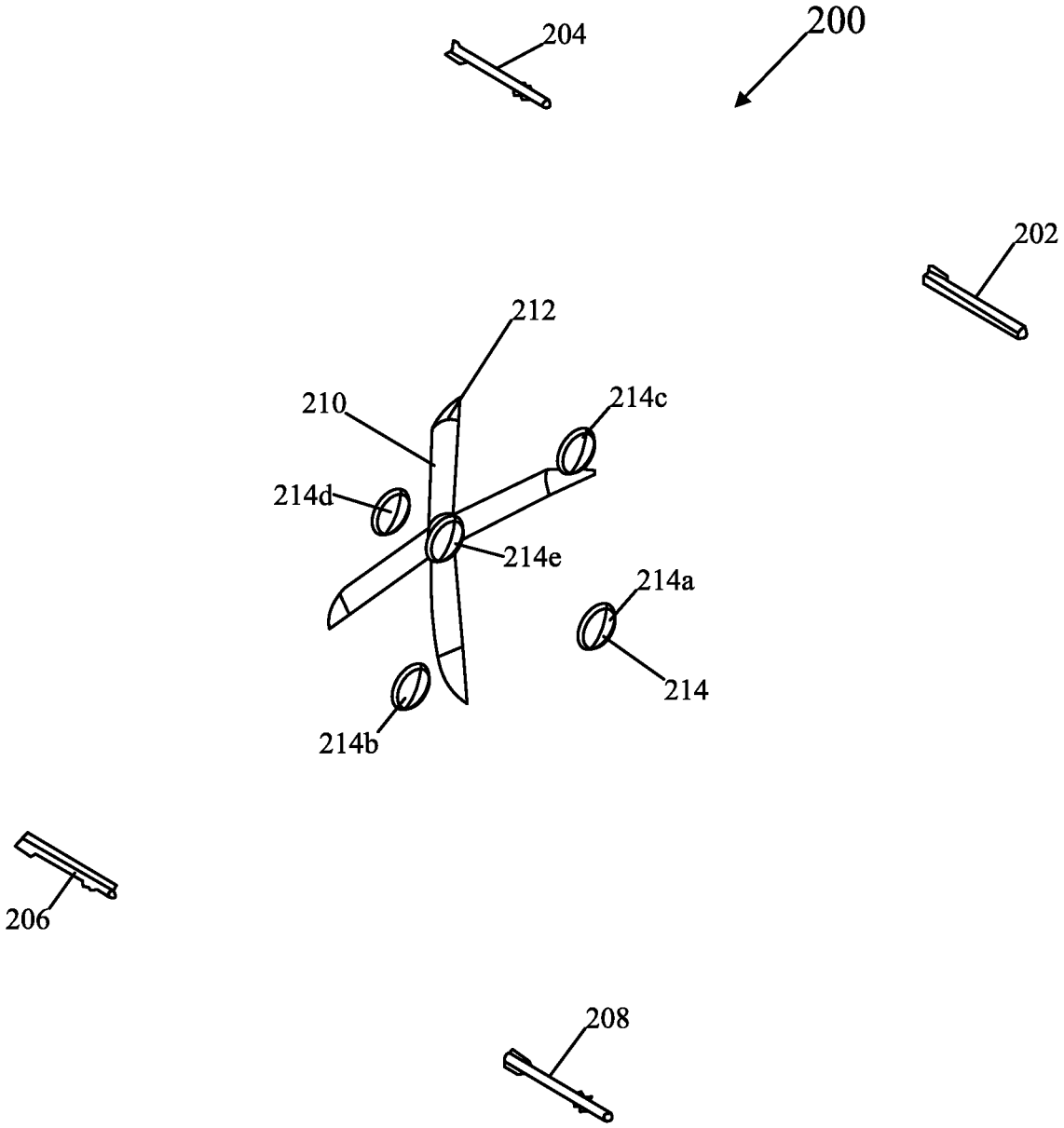
FIG. 6 shows a front, top, left perspective view of the net device of FIG. 2A, with the net device of FIG. 2A in a fifth state.

FIG. 6 shows a front, top, left perspective view of the net device 200, with the net device 200 in a fifth state in which the missiles 202, 204, 206, and 208 have spread out further; the sections 210 and 212 have opened further; and the disks 214 have spread apart.

Figure 7:
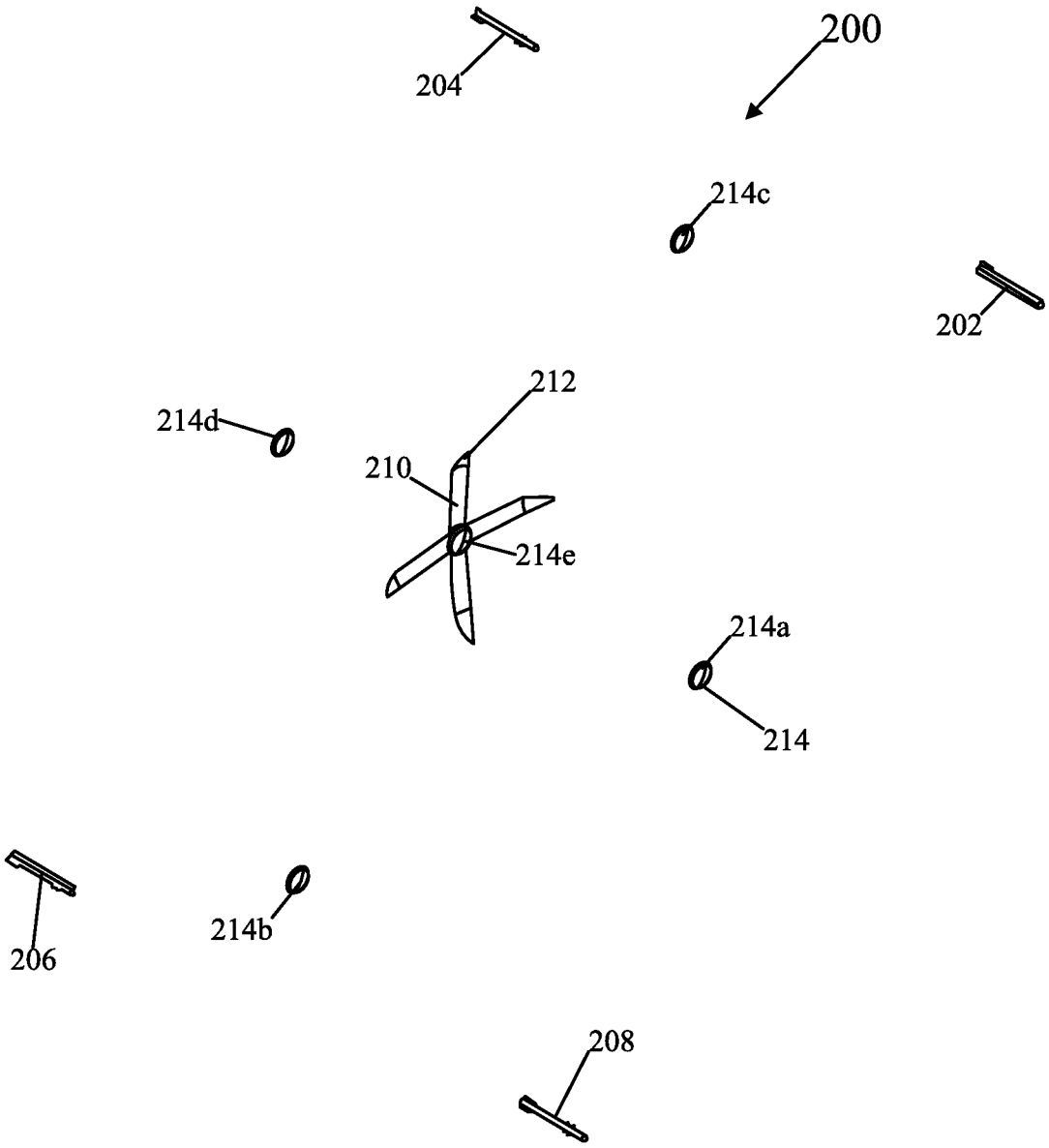
FIG. 7 shows a front, top, left perspective view of the net device of FIG. 2A, with the net device of FIG. 2A in a sixth state.

FIG. 7 shows a front, top, left perspective view of the net device 200, with the net device 200 in a sixth state in which the missiles 202, 204, 206, and 208 have spread out further; and the disks 214 have spread further apart.

Figure 8:
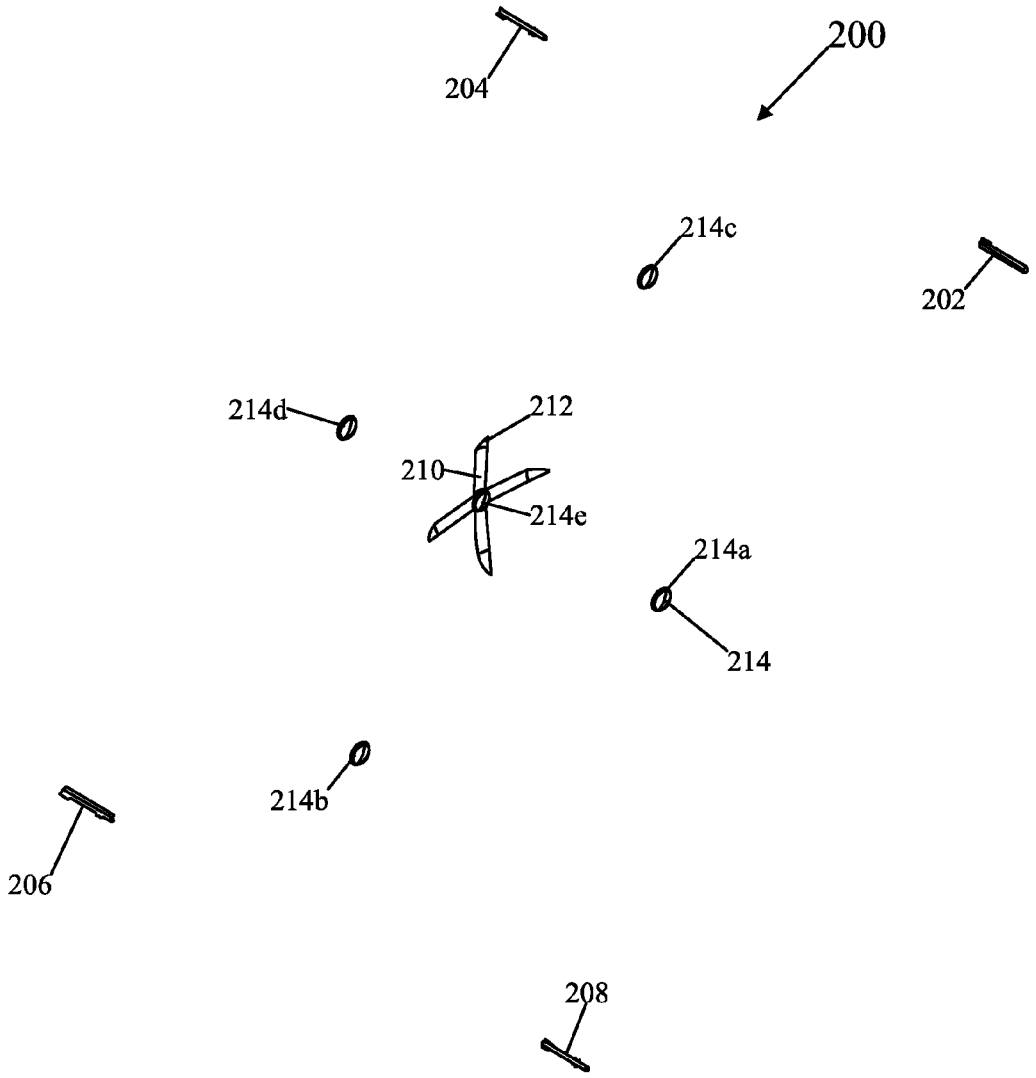
FIG. 8 shows a front, top, left perspective view of the net device of FIG. 2A, with the net device of FIG. 2A in a seventh state.
Figure 9A:
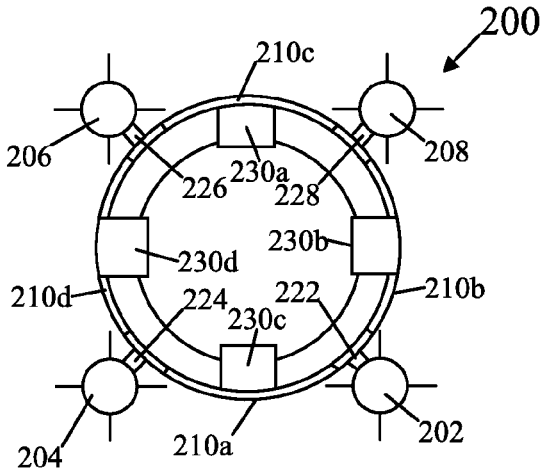
FIG. 9A shows a bottom view of the net device of FIG. 2A, with the net device of FIG. 2A in the first state.
Figure 9B:
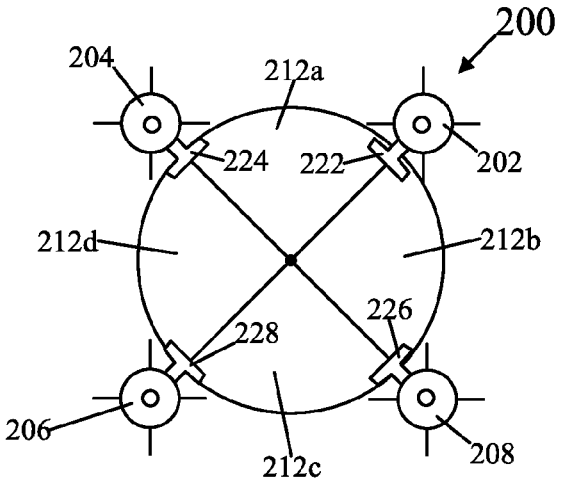
FIG. 9B shows a top view of the net device of FIG. 2A, with the net device of FIG. 2A in the first state.
Figure 9C:
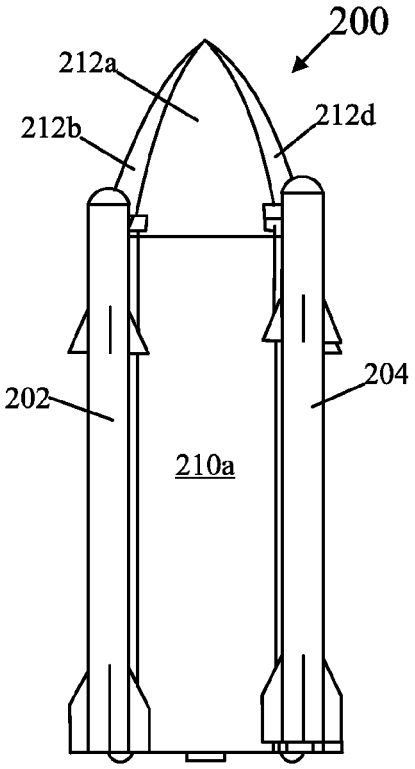
FIG. 9C shows a front view the net device of FIG. 2A, with the net device of FIG. 2A in the first state.
Figure 9D:
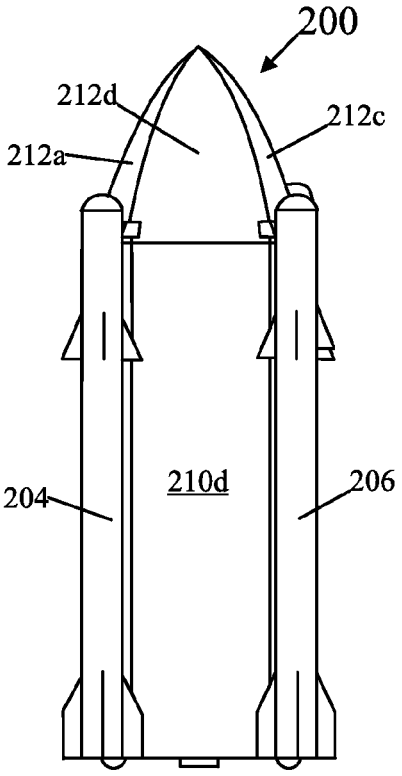
FIG. 9D shows a left view the net device of FIG. 2A, with the net device of FIG. 2A in the first state.
Figure 9E:
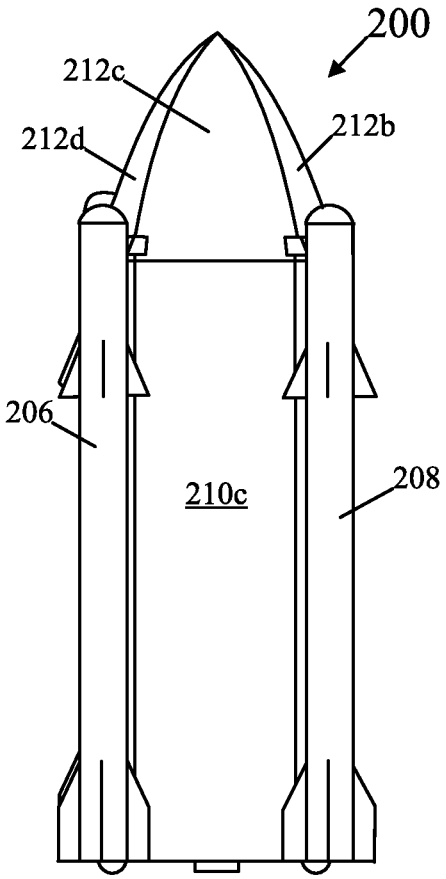
FIG. 9E shows a rear view the net device of FIG. 2A, with the net device of FIG. 2A in the first state.
Figure 9F:
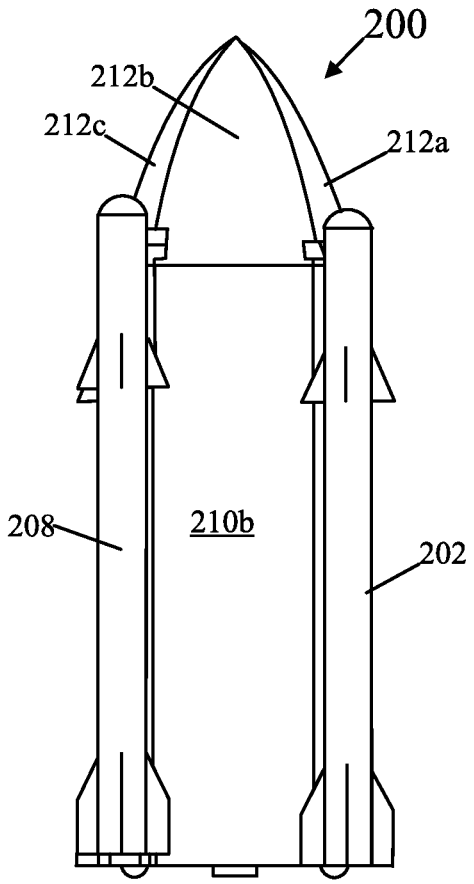
FIG. 9F shows a right view the net device of FIG. 2A, with the net device of FIG. 2A in the first state.

FIG. 8 shows a front, top, left perspective view of the net device 200, with the net device 200 in a seventh state in which the missiles 202, 204, 206, and 208 have spread out further and the disks 214 have spread further apart.

FIGS. 9A-F show bottom, top, front, left, rear, right views, respectively, of the net device 200, with the net device 200 in the first state.

Figure 10A:
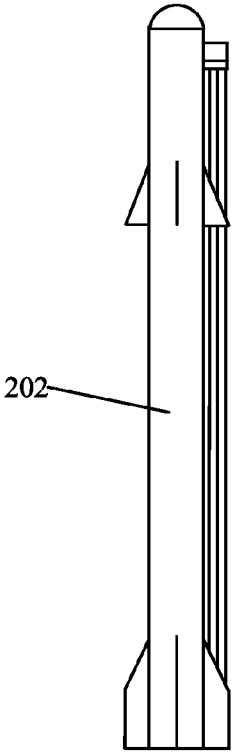
FIG. 10A shows a front view of a first missile for use with the net device of FIG. 2A.
Figure 10B:
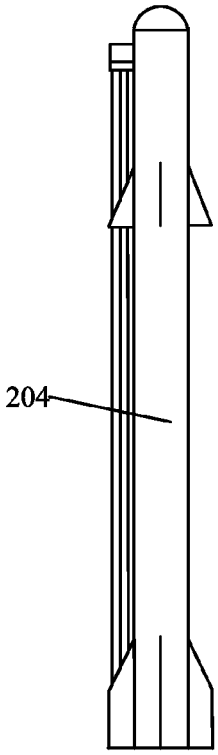
FIG. 10B shows a front view of a second missile for use with the net device of FIG. 2A.
Figure 10C:
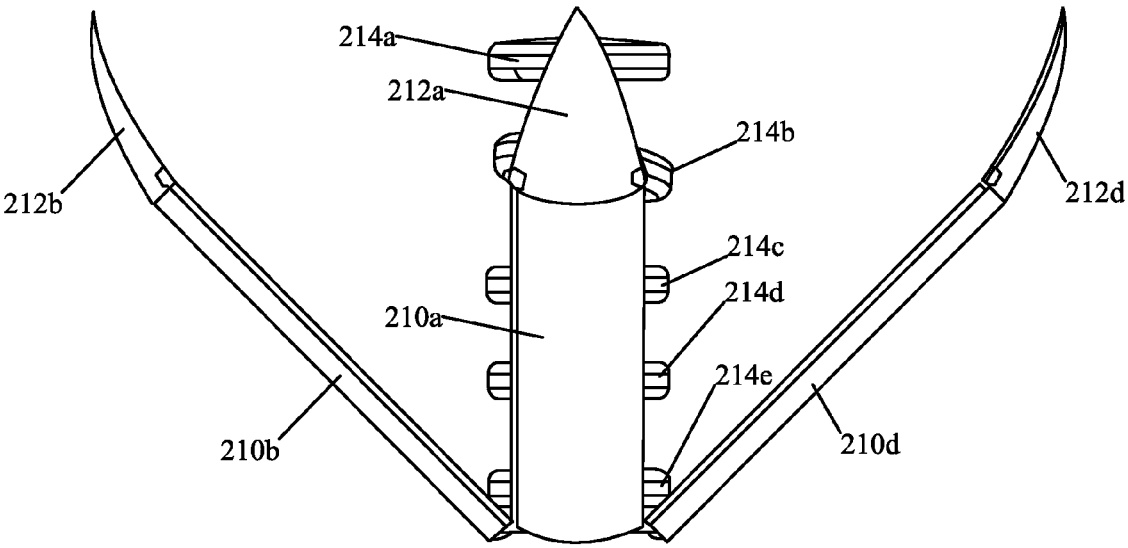
FIG. 10C shows a front view of part of the net device of FIG. 2A in an opened state.
Figure 11A:
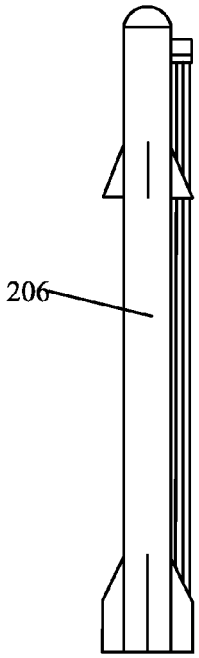
FIG. 11A shows a front view of a third missile for use with the net device of FIG. 2A.
Figure 11B:
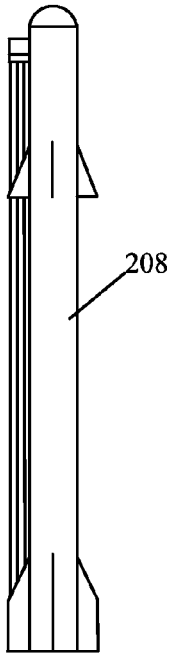
FIG. 11B shows a front view of a fourth missile for use with the net device of FIG. 2A.
Figure 11C:
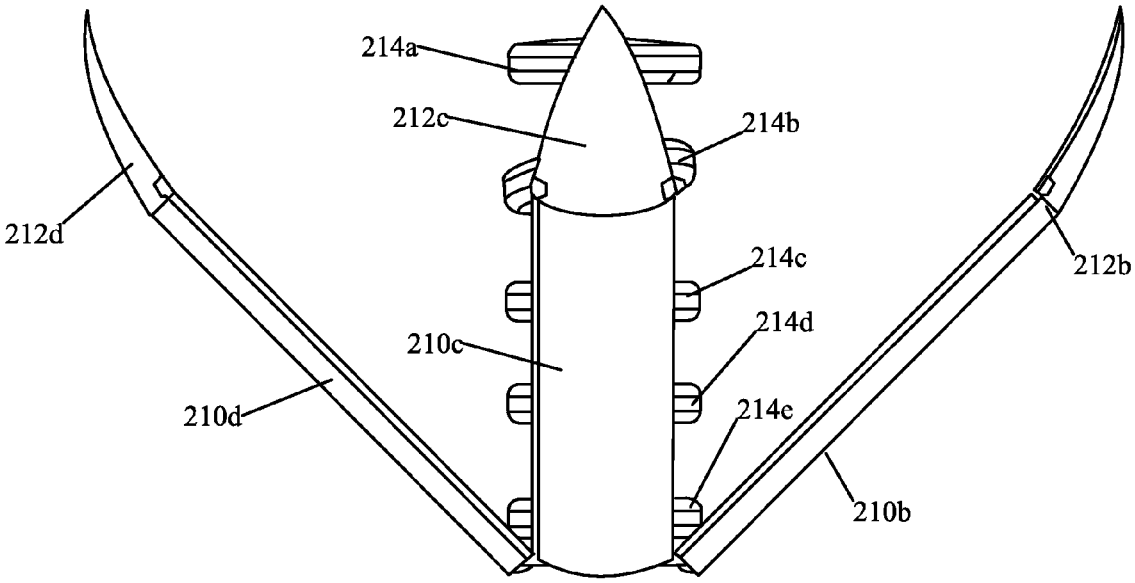
FIG. 11C shows a rear view of part of the net device of FIG. 2A in an opened state.

FIGS. 10A-B show a front view of the missile 202 and a front view of the missile 204, respectively, for use with the net device 200. FIG. 10C shows a front view of part of the net device 200 in an opened state;

FIGS. 11A-B show a front view of the missile 206 and a front view of the missile 208, for use with the net device 200 of FIG. 2A. FIG. 11C shows a rear view of part of the net device 200.

Figure 12A:
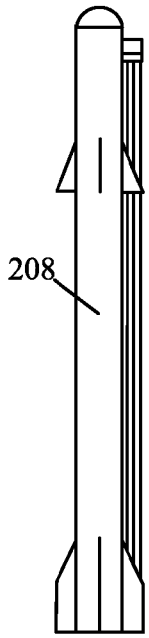
FIG. 12A shows a rear view of the fourth missile for use with the net device of FIG. 2A.
Figure 12B:
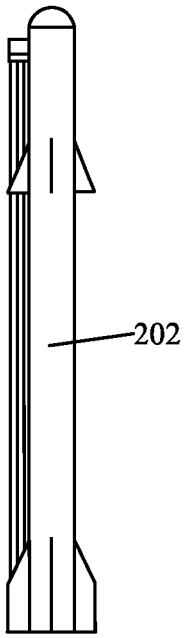
FIG. 12B shows a rear view of a first missile for use with the net device of FIG. 2A.
Figure 12C:
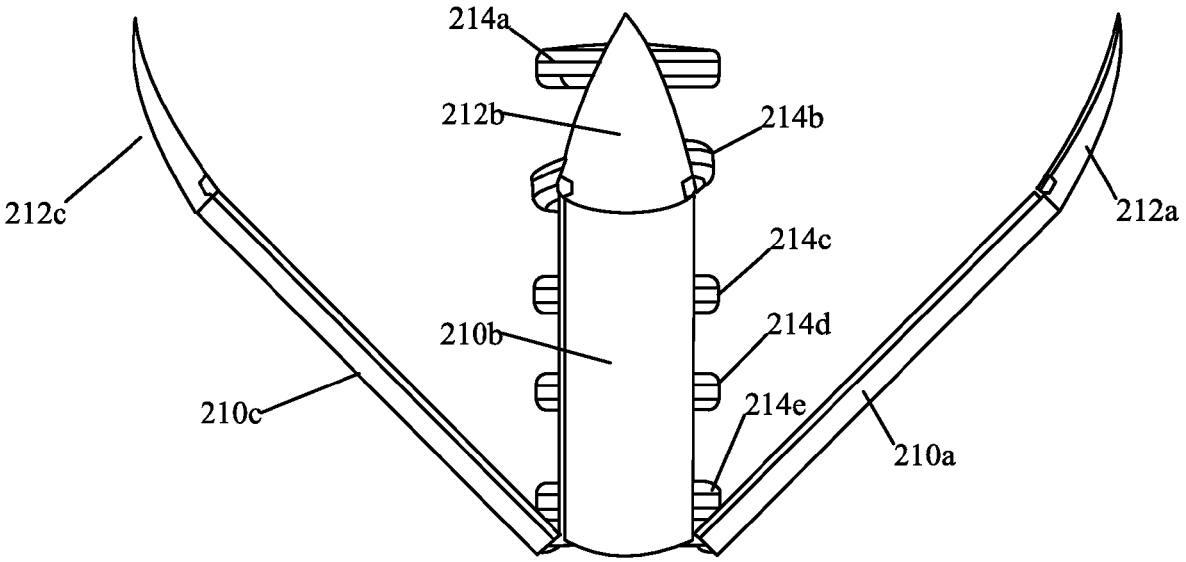
FIG. 12C shows a top view of part of the net device of FIG. 2A in an opened state.

FIG. 12A shows a rear view of the missile 208 for use with the net device 200. FIG. 12B shows a rear view of the missile 202 for use with the net device 200. FIG. 12C shows a right side view of part of the net device 200 in an opened state.

Figure 21:
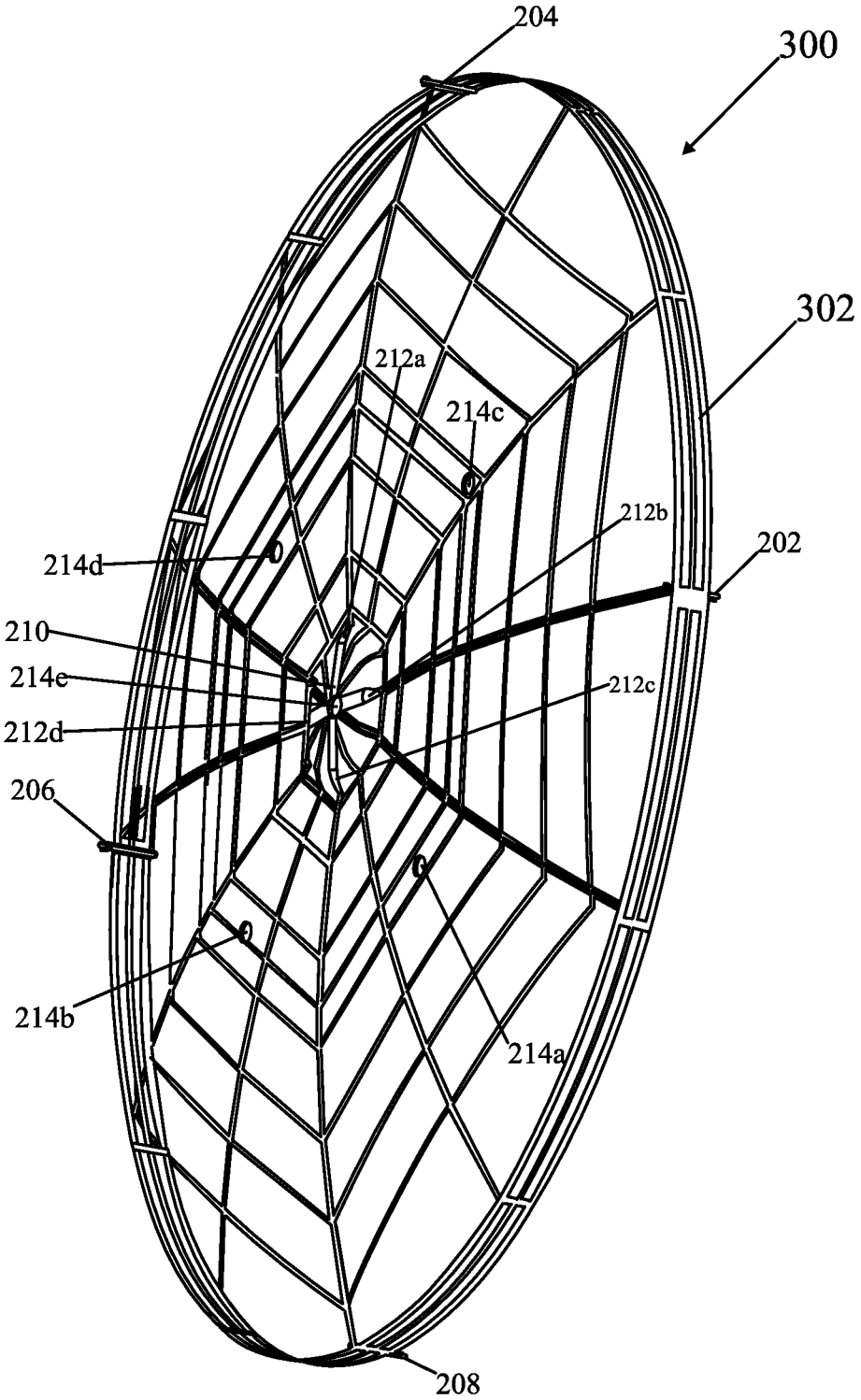
FIG. 21 shows a front, top, left perspective view of the net device of FIG. 2A along with a deployed net.

In at least one embodiment a net, such as net 302 shown in FIG. 21, may be guided/navigated either by manual input, such as through controller computer interactive device 8 of controller 1 or act autonomously or automatically, such as programmed by computer software stored in net device computer memory 102 and executed by net device computer processor 104. Each of the missiles 202-208 may include an apparatus 100 as shown in FIG. 1B or substantially the same apparatus as 100, with potentially different data or different control instructions for each of the missiles 202-208. Each of the disks 214*a-e* may include an apparatus 100 as shown in FIG. 1B, or substantially the same apparatus as 100, with potentially different data or different control instructions for each of the disks 214*a-e*, so that the disks or ordnances can receive data via transmitter/receiver 106 from the apparatus or controller 1 or from other missiles or other ordnances.

By controlling the flight direction and the flight velocity of the missiles 202-208 and the ordnances or disks 214*a-e* the apparatus 300 shown in FIG. 21, may be programmed by computer software stored in computer memory 2 or 102 to be navigated to hone-in, track, or intercept a target autonomously, using the net 302, such as in response to commands from controller 1 and/or computer processors 4 and/or 104. The net 302 thus may be navigated to hone-in, track, or intercept its target manually, i.e. through operator controller commands through interactive device 8, in a wired manner or wireless manner.

The net 302 shown in FIG. 21, in at least one embodiment, may have an outer or peripheral portion fixed to missiles 202, 204, 206, and 208 that opens up first to release and unfurl the formerly packed net 302. The net 302, once unfurled can be navigated via wire/wireless controls by controlling the flight direction and/or velocity of missiles 202-208 and/or ordnances 214*a-e*. The net 302 that once unfurled can navigate autonomously in at least one embodiment, such as in accordance with programming or data stored in computer memory 2 or 102. Once deployed, the inside portion of the net 302, connected to the sections 212*a-e*, shown in FIG. 21 facing the target may be convex in shape. The net 302 may have an explosive device or devices, such as ordnances 214*a-e* and one or more of the missiles 202-208 could also carry an explosive charge to terminate a target. The net 302 may have an outer casing which serves as a center piece once deployed. At the center of the net 302 are outer casings of sections or portions 210, 210*a*, 210*b*, 210*c*, 210*d*, 212, 212*a*, 212*b*, 212*c*, and 212*d*. The portions 210, 210*a-d*, 212, and 212*a-d* may be more rigid than the outer portion of the net 302, once the net 302 is deployed.

Figure 13:
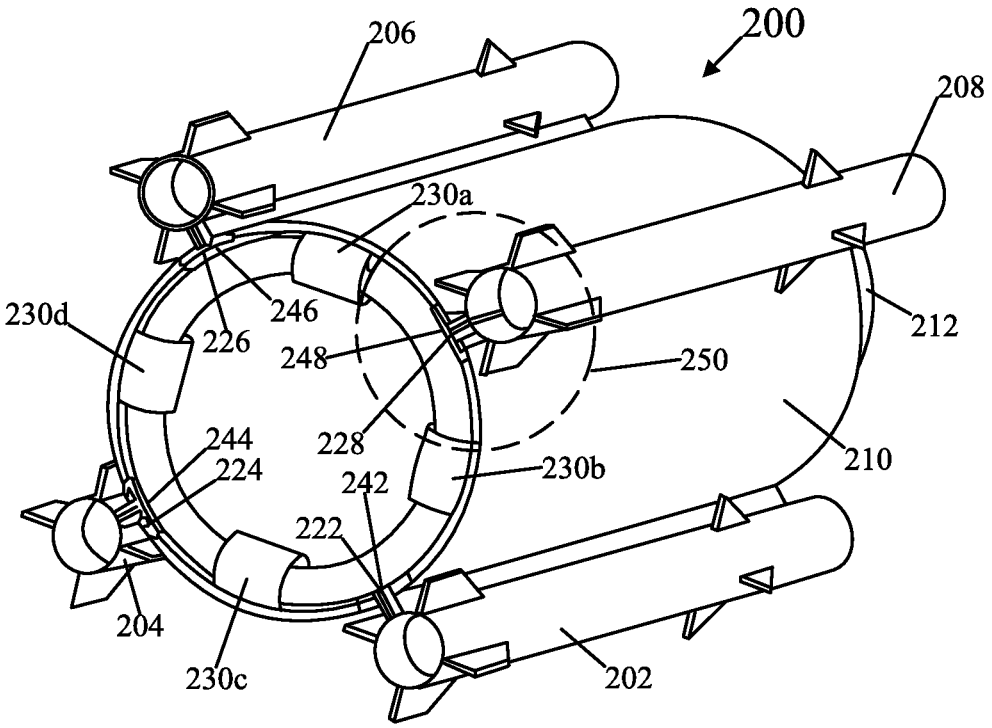
FIG. 13 shows a bottom, right, and rear perspective view of the net device of FIG. 2A, with the net device of FIG. 2A in the first state.
Figure 14:
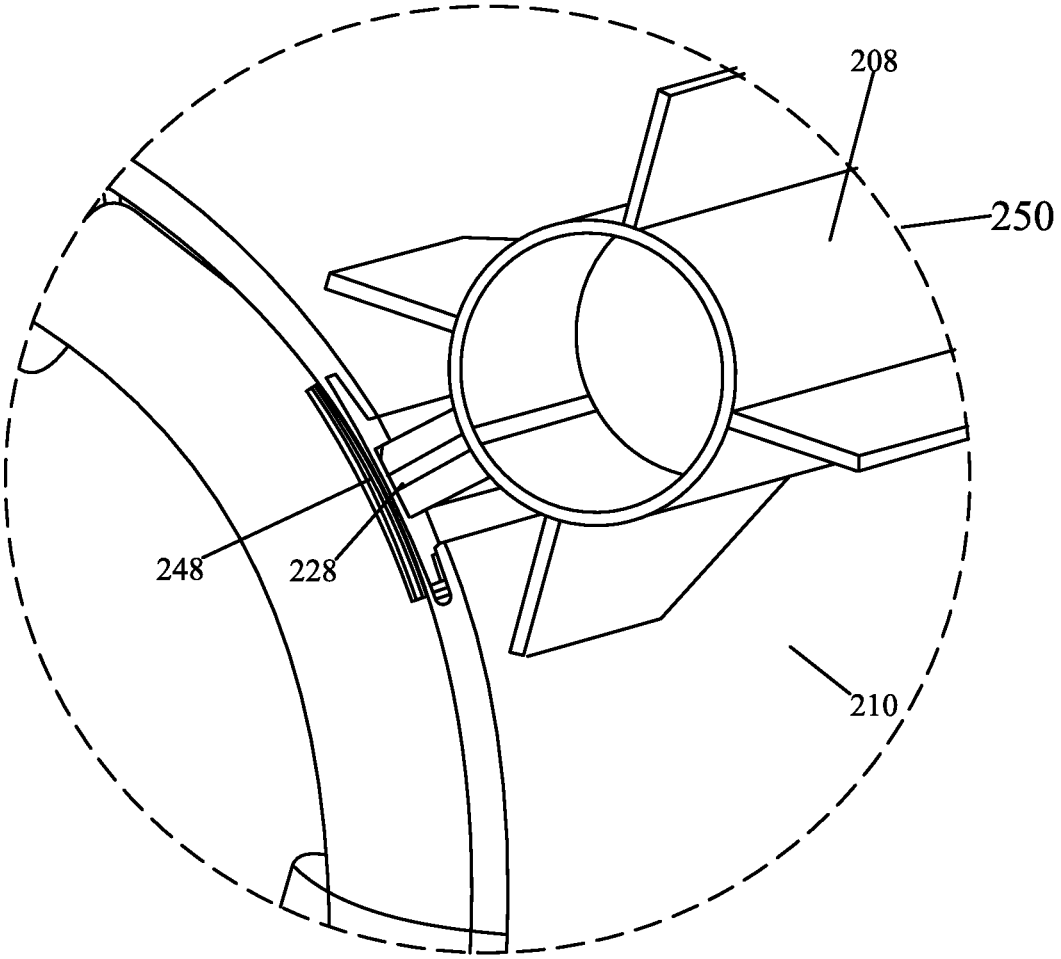
FIG. 14 shows a closeup view of a portion of FIG. 13.

FIG. 13 shows a bottom, right, and rear perspective view of the net device 200, with the net device 200 in the first state, in which missiles 202, 204, 206, and 208 are attached and aligned with respect to body portion 210 as shown in FIGS. 9C-9F. Missiles 202, 204, 206, and 208 have members 222, 224, 226, and 228 which are shown completely slid into and attached to slots 242, 244, 246, and 248, respectively, of body portion 210 in FIG. 13. A circular closeup area 250 shown in FIG. 14 shows the protruding member 228 slid into the slot 248. The other protruding members 222, 224, and 226 are slid into their respective slots 242, 244, and 246, respectively, in a similar or an identical manner.

Figure 15:
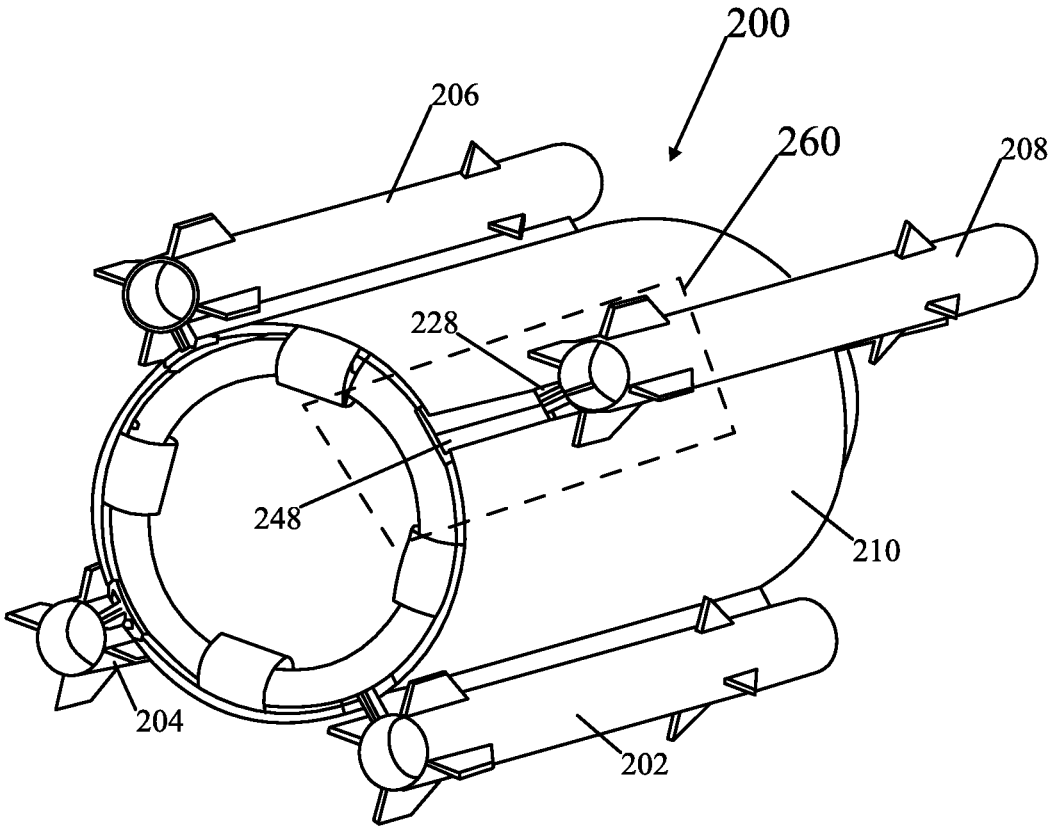
FIG. 15 shows a bottom, right, and rear perspective view of the net device of FIG. 2A, with the net device of FIG. 2A in an eighth state.
Figure 16:
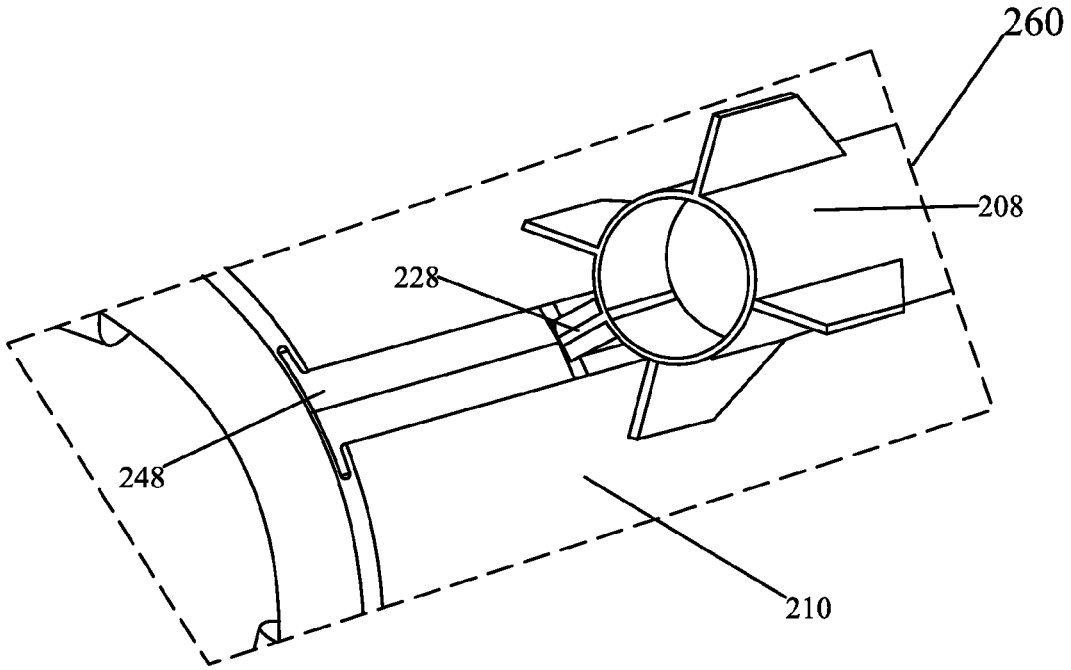
FIG. 16 shows a closeup view of a portion of FIG. 15.

FIG. 15 shows a bottom, right, and rear perspective view of the net device 200, with the net device 200 in an eighth state. In FIG. 15, the missile 208 has been slid partially out of the body portion 210, so that the protrusion 228 is now partially out of the slot 248. FIG. 16 shows a closeup view of an area or portion 260 of FIG. 15.

Figure 17:
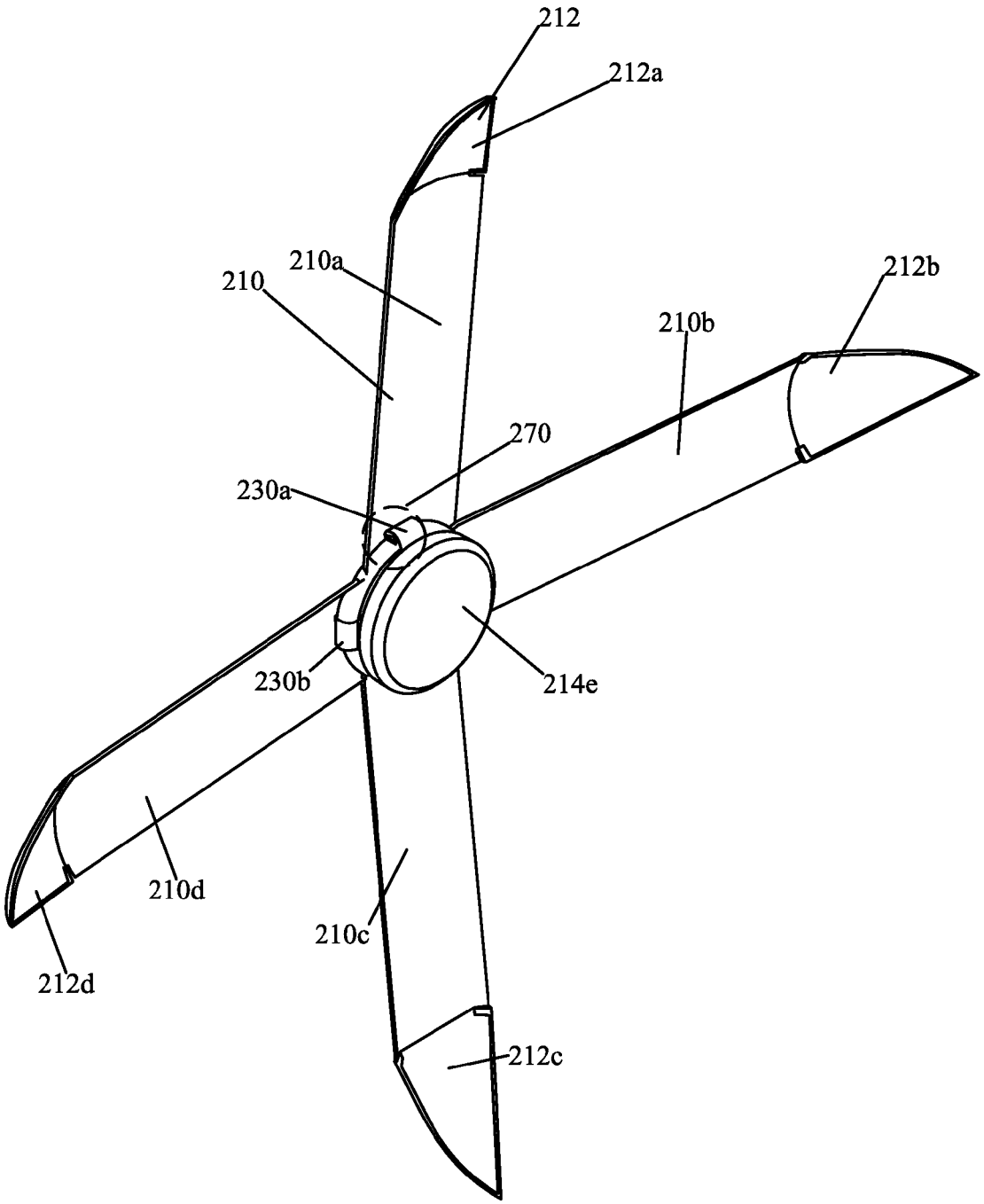
FIG. 17 shows a front, top, left perspective view of a portion of the net device of FIG. 2A, with the net device of FIG. 2A in the fifth state as in FIG. 6.
Figure 18:
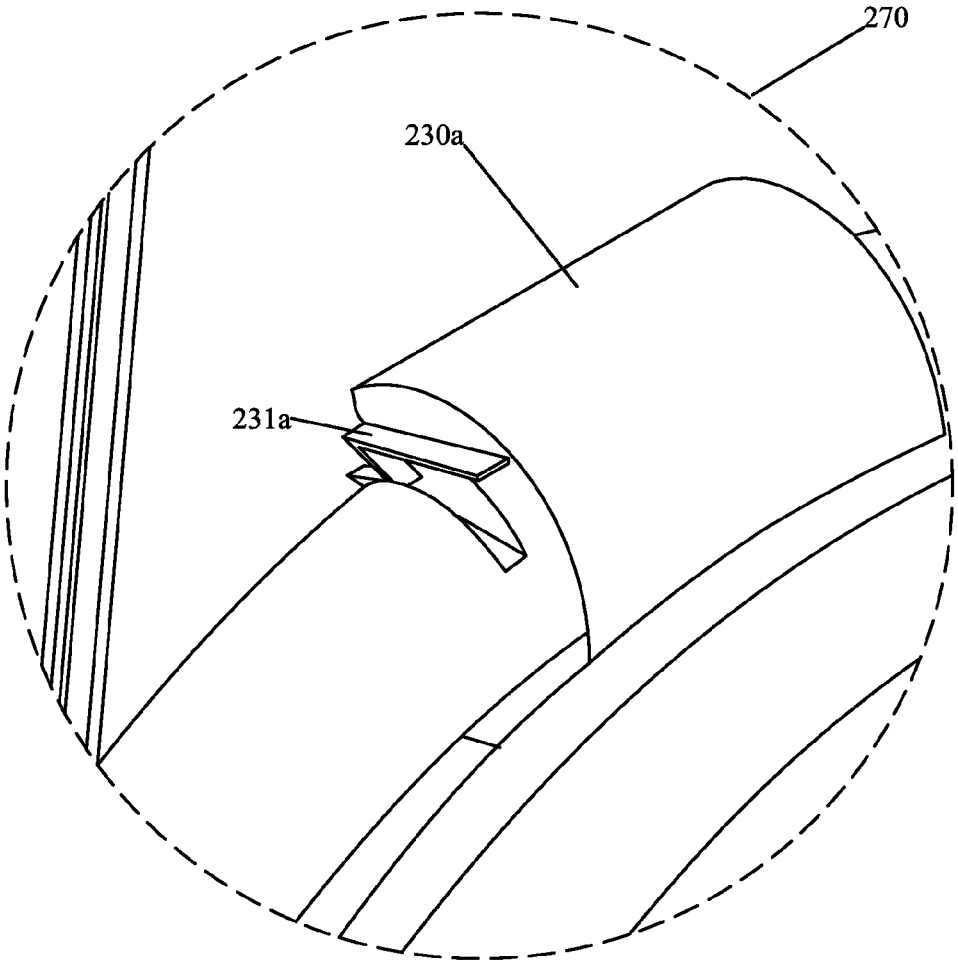
FIG. 18 shows a closeup view of a portion of FIG. 17.

FIG. 17 shows a front, top, left perspective view of a portion of the net device 200, with the portion of the net device 200 in the fifth state as in FIG. 6. FIG. 18 shows a closeup view of a portion or area 270, shown by dashed lines, of FIG. 17.

FIG. 18 also is a close up of a section or circular pivot arm 230*a* in FIG. 17. Looking towards the left of the circular pivot arm 230*a* you see mechanism 231*a* The mechanism 231*a*, in at least one embodiment, is a spring, which helps to open up the outer casing or sections 210*a* and 212*a* once the missiles 202, 204, 206, and 208 take off. The springing or opening up of mechanism 231*a* may be controlled by the computer processors 4 and/or 104 of FIGS. 1A and 1B, respectively. Sections 210*b* and 212*b*, sections 210*c* and 212*c*, and sections 210*d* and 212*d* may have spring mechanisms similar to or identical to mechanism 231*a*, for opening those sections and they may be controlled by processors 4 and/or 104.

Figure 19:
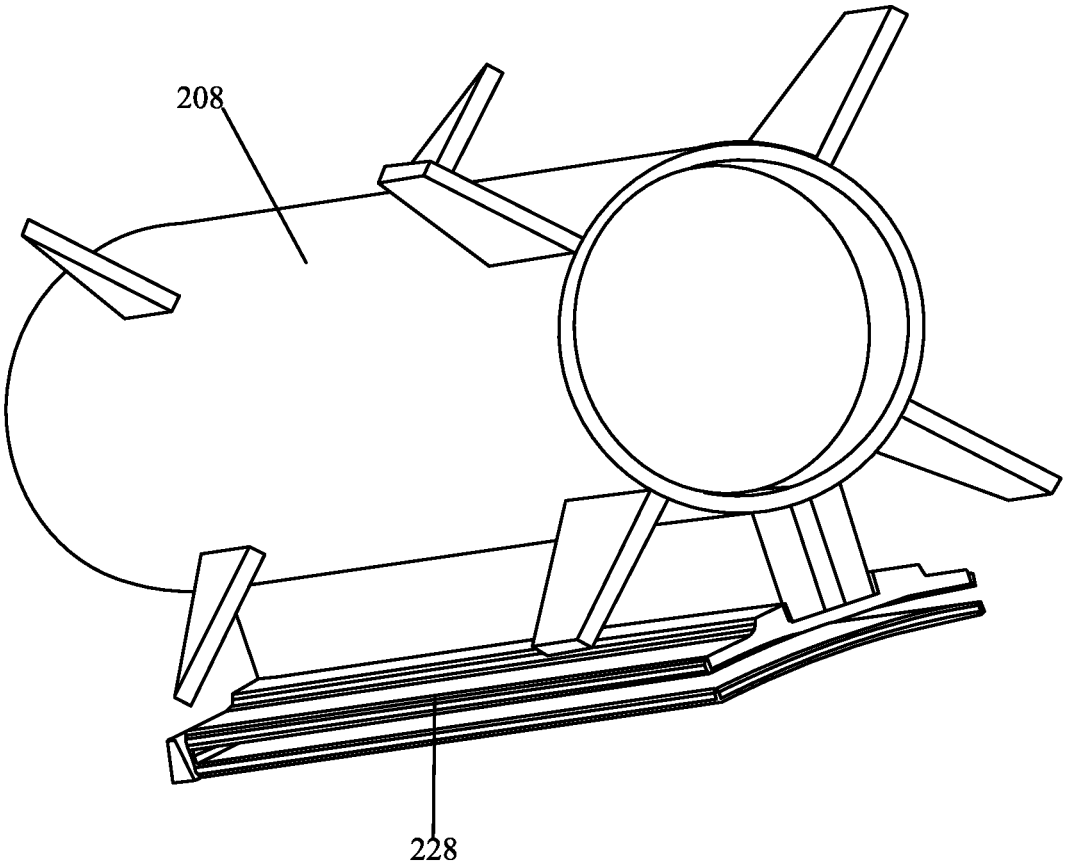
FIG. 19 shows a bottom, right and rear perspective view of a missile of the net device of FIG. 2A.
Figure 20:
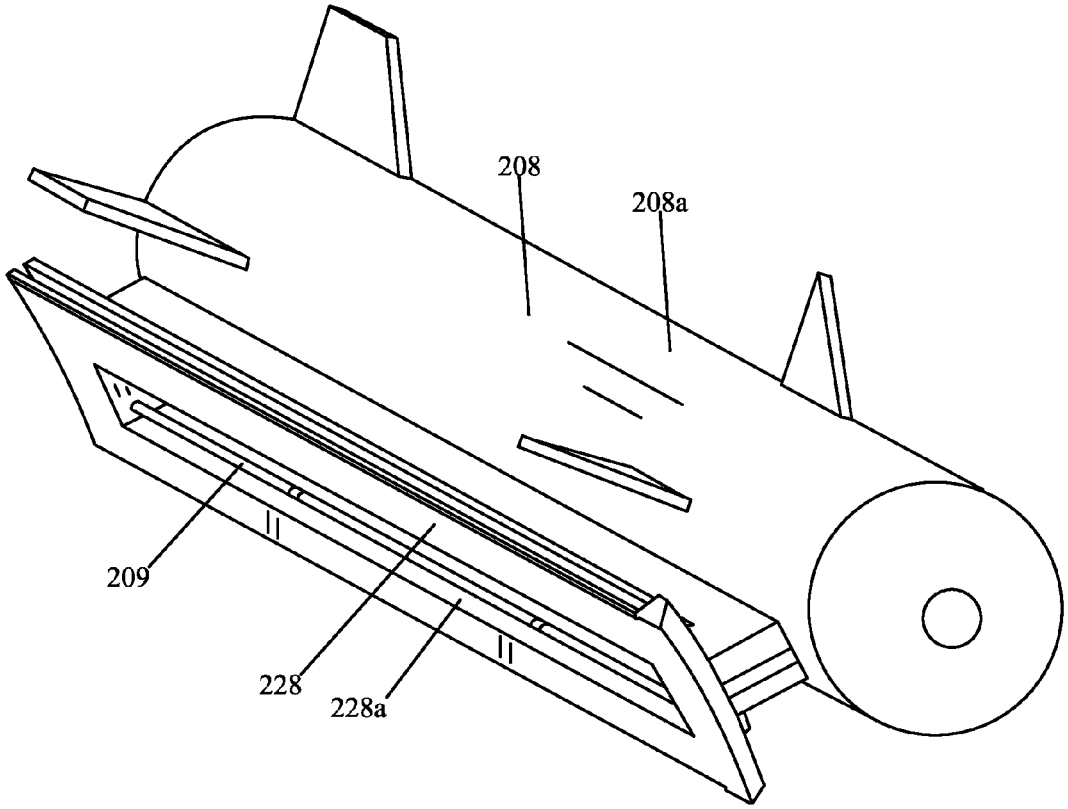
FIG. 20 shows a top, left, and front perspective view of the missile of FIG. 19.

FIG. 19 shows a bottom, right and rear perspective view of a missile 208 of the net device 210. FIG. 20 shows a top, left, and front perspective view of the missile 208.

In at least one embodiment, section 228 in FIG. 19, has a dual function. First to keep the outer casing close and second, to attach the net 302 to the missile 208. Each of the missiles 202, 204, and 206 would have a component identical or substantially similar to section 228.

FIG. 21 shows a front, top, left perspective view of the net device 200 in a deployed state as in FIG. 8, along with a deployed net 302. The deployed net 302 and the net device 200 form a combined apparatus 300 in FIG. 21. In FIG. 21, the missiles 202, 204, 206, and 208 are fixed to east, north, west, and south outer or peripheral sections of the net 302. In addition the sections 212*a*, 212*b*, 212*c*, and 212*d* of the net device 200 are connected to different inner sections of the net 302. Disks 214*a-e* are example of ordnances, and, at least in one embodiment they are attached to parts of the net 302.

In operation, the net 302 can be stored in an inner chamber enclosed by sections 210*a-d* and 212*a-d* when the net device 200 is in a closed state as in FIG. 2B, with the exception of peripheral sections 228 of the net 302 which may be fixed to the missiles 202, 204, 206, and 208. When the missiles 202, 204, 206, and 208 are launched to the stage shown in FIG. 3, the missiles 202, 204, 206, and 208 pull on the peripheral sections to which they are attached to cause the net 302 to open and/or deploy. In addition the sections 210*a-d* and 212*a-d* open up releasing the majority of the net 302 from the inner chamber (enclosed by sections 210*a-d* and 212*a-d* in FIG. 2B state) and allowing the majority of the net 302 to deploy and/or fully open. The missiles 202, 204, 206, and 208 progress from the state or stage of FIG. 4, next to the state or stage of FIG. 5, next to the state or stage of FIG. 6, next to the state or stage of FIG. 7, and finally approximately to the state or stage of FIG. 8, which may correspond substantially to FIG. 21. The net 302 is only shown in FIG. 21 for explanatory purposes, but the net 302 would be included in all the states shown in FIG. 2A-FIG. 8.

Each of the missiles 202, 204, 206, and 208 may have their flight direction and/or flight velocity controlled by the controller computer processor 4 shown in FIG. 1A and/or the net device computer processor 104 shown in FIG. 1B. The flight direction and/or flight velocity of the missiles 202, 204, 206, and 208 may be predetermined by data stored in the computer memory 2 or 102 shown in FIGS. 1A and 1B, respectively. The flight direction and/or flight velocity of the missiles 202, 204, 206, and 208 may be controlled by an operator through interactive devices 8 and 108 shown in FIGS. 1A and 1B, respectively.

The net 302 shown in FIG. 21 can be made entirely or substantially of any lightweight synthetic material that is durable. The ordnances or disks 214*a-e* can be attached to the net 302 in any particular manner. Each of the missiles 202, 204, 206, and 208 shown in FIG. 21, typically have one or more fins, that are moveable so once the missiles 202, 204, 206, and 208 are clear of the main body or sections 210*a-d* and 212*a-d*, the missiles 202, 204, 206, and 208 can go forward diagonally up to the right or left, or diagonally down and to the side right or left accordingly based on the original position of the missiles when they were attached to the main body or sections 210*a-d* and 212*a-d*. Naturally as the missiles 202, 204, 206, and 208 diverge given that the net 302 is attached to them (at the periphery of the net 302) and attached to the net 302 is the ordnances 214*a-e*, the apparatus 300, will unfurl to a final position as seen in FIG. 21. The final position, shown in FIG. 21, does not have to be circular, it can be any shape based on need or user preference. Each of the ordnances 214*a-e* may be an explosive device which can be triggered to explode by a remote control signal, such as a remote control signal from controller computer processor 4 through controller transmitter/receiver 6.

As shown in FIG. 20, the missile 208 may include a slot 228*a* in which is located a rod 209, circular as a cylindrical rod, to which a part of the net 302 is fixed. The rod 209 is typically recessed into recess 228*a* of member 228. The rod 209 may, in at least one embodiment be recessed further back into the slot or recess 228*a*, i.e. closer to the body or cylindrical portion 208 of the missile 208. The missiles 202, 204, and 206 may be identical to the missile 208 but may have recessed rods (similar or identical to rod 209) connected to other portions of the net 302 as shown by FIG. 21.

In at least one embodiment, the sections 210*a-d* and 212*a-d* may open up to release the packed net 302 and this may be controlled by computer processors 4 and/or 104 of FIG. 1. The net 302 can be guided by the missiles 202, 204, 206, and 208 either by manual input, such as into controller computer interactive device 8 to control the flight direction and/or speed of missiles 202, 204, 206, and 208 via processor 4 and controller transmitter/receiver 6 or autonomously such as programmed in computer memory 2 and/or computer memory 102.

The missiles 202, 204, 206, and 208 can be used before unfurling or release of the net 302 to navigate to, to hone in, track or intercept a target. When the target is reached, the net 302 can be unfurled and/or released as previously described. This can also be done by operator control using device 8 or by preprogrammed control via memory 2 and/or 102 using processors 4 and/or 104.

Ordnances 214*a-e* may be attached to the net 302, and the ordnances 214*a-e* may be used to explode and/or destroy a target.

The portions 210*a-d* and 212*a-d* are at the center of the net 302, once the net 302 is unfurled as in FIG. 21. In at least one embodiment, the portions 210*a-d* and 212*a-d* are more rigid than the net 302 in FIG. 21.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a body portion;

a plurality of missiles attached to the body portion in a manner which allows the plurality of missiles to detach from the body portion;

a net having a plurality of locations, wherein each missile is attached to the net at a different location of the plurality of locations; and a means for controlling, wherein the means for controlling at least partially controls a flight direction and a flight speed of each of the plurality of missiles.

2. The apparatus of claim 1 wherein the means for controlling includes a computer processor.

3. The apparatus of claim 1 wherein at least a majority of the net lies inside of an inner chamber inside of the body portion;

and the at least a majority of the net is configured to come out of the inner chamber in response to a command from a control device.

4. The apparatus of claim 3 wherein the body portion is configured to go from a closed state to an open state in response to the command from the control device, wherein in the closed state the net can not come out of the inner chamber of the body portion, and wherein in the open state the net comes out of the inner chamber of the body portion.

5. The apparatus of claim 1 wherein the net is substantially circular;

and wherein the plurality of missiles includes a first missile attached to a northern location of the net, a second missile attached to a southern location of the net, a third missile attached to a western location of the net, and a fourth missile attached to an eastern location of the net.

6. The apparatus of claim 5 wherein the northern location on the net is at the periphery of the net;

the southern location on the net is at the periphery of the net;

the eastern location on the net is at the periphery of the net; and the western location on the net is at the periphery of the net.

7. The apparatus of claim 1 further comprising a first ordnance attached to the net.

8. The apparatus of claim 7 wherein the first ordnance is an explosive device which explodes when triggered by a remote control signal.

9. The apparatus of claim 7 wherein the net has a periphery; and wherein the plurality of missiles are attached to the net and the first ordnance is attached to the net so that the plurality of missiles are closer to the periphery than the first ordnance.

10. The apparatus of claim 1 wherein each of the plurality of missiles includes a computer processor, such that there are a plurality of computer processors, one for each of the plurality of missiles, wherein the flight direction and the flight speed of each of the plurality of missiles is at least partially controlled by its computer processor.

11. A method comprising the steps of:

packing a majority of a net into an inner chamber of a body portion;

attaching the net to a plurality of missiles;

attaching the plurality of missiles to the body portion;

launching and detaching the plurality of missiles from the body portion; and controlling a flight direction and a flight speed of each of the plurality of missiles to cause the majority of the net to come out of the inner chamber of the body portion and to cause the majority of the net to expand.

12. The method of claim 11 wherein all of the flight directions and all of the flight speeds of all of the plurality of missiles are at least partially controlled by a first computer processor.

13. The method of claim 11 wherein the majority of the net is configured to come out of the inner chamber in response to a command from a control device.

14. The method of claim 13 wherein the body portion is configured to go from a closed state to an open state in response to the command from the control device, wherein in the closed state the majority of the net can not come out of the inner chamber of the body portion, and wherein in the open state the majority of the net comes out of the inner chamber of the body portion.

15. The method of claim 11 wherein the net is substantially circular;

and wherein the plurality of missiles includes a first missile attached to a northern location of the net, a second missile attached to a southern location of the net, a third missile attached to a western location of the net, and a fourth missile attached to an eastern location of the net.

16. The method of claim 15 wherein the northern location on the net is at the periphery of the net;

the southern location on the net is at the periphery of the net;

the eastern location on the net is at the periphery of the net; and the western location on the net is at the periphery of the net.

17. The method of claim 11 further comprising a first ordnance attached to the net.

18. The method of claim 17 wherein the first ordnance the first ordnance is an explosive device which explodes when triggered by a remote control signal.

19. The method of claim 17 wherein the net has a periphery; and wherein the plurality of missiles are attached to the net and the first ordnance is attached to the net so that the plurality of missiles are closer to the periphery than the first ordnance.

20. The method of claim 12 wherein each of the plurality of missiles includes a further computer processor, such that there are a plurality of further computer processors, on for each of the plurality of missiles, wherein the flight direction and the flight speed of each of the plurality of missiles is at least partially controlled by its further computer processor.

* * * * *